US006565458B1

(12) United States Patent
Cameron

(10) Patent No.: US 6,565,458 B1
(45) Date of Patent: May 20, 2003

(54) TURF REPAIR DEVICE

(75) Inventor: Don T. Cameron, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 09/670,575

(22) Filed: Sep. 27, 2000

(51) Int. Cl.[7] ..... A63B 57/00
(52) U.S. Cl. ..... 473/408
(58) Field of Search ..... 473/408, 286; D21/793; 172/360, 378

(56) References Cited

U.S. PATENT DOCUMENTS

| | | | | | |
|---|---|---|---|---|---|
| 1,494,557 | A | * | 5/1924 | Lumry et al. | 254/131.5 |
| 3,061,270 | A | * | 10/1962 | Lowe | 172/378 |
| 3,458,981 | A | * | 8/1969 | Banner | 172/378 |
| 4,627,621 | A | | 12/1986 | Tate | |
| 4,815,778 | A | | 3/1989 | Hoch | |
| 4,984,790 | A | * | 1/1991 | Dowdy et al. | 473/408 |
| 5,121,519 | A | * | 6/1992 | Haugom | 473/408 |
| 5,143,371 | A | | 9/1992 | Strahan | |
| 5,209,469 | A | | 5/1993 | Laskowitz et al. | |
| 5,292,120 | A | | 3/1994 | Pehoski et al. | |
| 5,393,052 | A | | 2/1995 | Kennedy | |
| 5,401,019 | A | | 3/1995 | Wissman et al. | |
| 5,529,299 | A | * | 6/1996 | Bellagamba | 473/408 |
| 5,645,500 | A | * | 7/1997 | Borden | 473/408 |
| 5,759,120 | A | * | 6/1998 | Mathis et al. | 473/408 |
| 5,765,647 | A | * | 6/1998 | Hood | 473/408 |
| D403,389 | S | | 12/1998 | Kim | |
| 5,871,058 | A | * | 2/1999 | Naccarato et al. | 172/378 |
| 6,033,322 | A | | 3/2000 | England | |
| D422,664 | S | | 4/2000 | Tate | |
| D424,151 | S | | 5/2000 | Miura | |
| D425,164 | S | | 5/2000 | Tate | |
| 6,095,935 | A | * | 8/2000 | Gooselaw et al. | 473/408 |
| D432,198 | S | * | 10/2000 | Adam | D21/793 |
| D432,625 | S | * | 10/2000 | Chan | D21/793 |
| 6,224,502 | B1 | | 5/2001 | Warfield | 473/408 |

FOREIGN PATENT DOCUMENTS

| | | |
|---|---|---|
| JP | 7-213661 | 8/1995 |

* cited by examiner

*Primary Examiner*—Steven Wong
(74) *Attorney, Agent, or Firm*—Swidler Berlin Shereff Friedman, LLP

(57) ABSTRACT

The present invention is directed to a turf repair device having a base member with first and second portions. The first portion has at least one extension extending therefrom. The second portion is oppositely disposed on the base member from the extension. A pivot member is associated with the base member for pivotal movement of the first and second portions. Additionally, an angle is disposed between the first and second portions such that the two portions are not co-planar. A folding joint is also included such that said first portion is collapsible toward said second portion.

2 Claims, 4 Drawing Sheets

TURF REPAIR DEVICE

FIELD OF INVENTION

The present invention relates generally to a repair device for use in repairing playing turfs. More particularly, the present invention relates to a device for repairing irregularities formed on the playing turf in the game of golf.

BACKGROUND OF THE INVENTION

In the game of golf, irregularities such as indentations on the playing turf are often formed when a golf ball or a golf club impacts the playing turf or the grounds of the golf course. Such irregularities can create undesirable playing conditions especially when the irregularities are formed on the putting green, where special care has been taken by the grounds keepers to maintain a smooth and well-manicured playing surface. These irregularities, however, are often inevitable during a regular round of golf. Fortunately, the damage may often be mitigated or minimized by lifting the soil surrounding the irregularity. Moreover, these irregularities often heal faster when they are mended shortly after they are formed. Accordingly, as common courtesy to others, golfers often fix or mend these irregularities during the course of play as a part of their game to maintain a smooth playing surface for subsequent players.

One type of turf irregularity associated with the game of golf is a ball mark, or often referred to as a divot, that is formed when the golf ball lands on the ground with sufficient force as to make a mark thereon. Alternatively, irregularities of the playing turf may be formed by the golf club during the execution of a golf swing. As used herein, a ball mark refers generally to all types of irregularities formed on the playing turf of the golf course by a player during the golf game either on the putting green, fairway or any other part of the course by a golf ball or a golf club. A ball mark can be substantial in size especially when the ground is soft due to moisture. Many devices have been created to mend ball marks. These devices are often constructed so that they are compact in size and may be easily carried by the golfers to perform this function.

For example, U.S. Pat. No. 5,143,371 to Strahan, discloses a golfer's aid having a body in the shape of a clip that is attachable to the belt loop on a golfer. A blade is rotatably attached to the clip and is rotatable to expose a divot repair tool. The divot repair tool has a general U-shape with two elongated members to serve as the divot tool. The user grips the body and inserts the elongated members into the soil surrounding the divot or ball mark. The base member is then pivoted against the index finger of the golfer to loosen the impacted soil created by the golf club or ball.

Similarly, U.S. Pat. No. 5,292,120 to Pehoski et al, is directed to a flat tool having various functions and features, including a divot repair device. The tool includes two legs extending from a base member that are spaced part at their open ends. The legs are tapered slightly and are inserted into the sod to repair a divot. U.S. Pat. Nos. 4,960,278, 5,393,052, and others all disclose similar flat plate like tools having legs insertable into the sod for repairing turf irregularities. These known devices are all used in a similar fashion to repair ball marks and divots.

SUMMARY OF THE INVENTION

The present invention is directed to a turf repair device having a base member with first and second portions. The first portion has at least one extension extending therefrom. The second portion is oppositely disposed on the base member from the extension. A pivot member is associated with the base member for pivotal movement of the first and second portions.

Additionally, the turf repair device may include an angle between the first and second portions such that the two portions are non-planar. Preferably the angle is formed on the side of the base member opposite from the pivot member. The assembly therefore further facilitates the pivotal movement of the turf repair device in repairing irregularities on the playing turf.

A folding joint may also be included between the first and second portions such that the first portion is collapsible toward the second portion. Preferably, in the collapsed configuration, the turf repair device is about half its original size, which is more compact and portable.

DESCRIPTION OF THE PREFERRED EMBODIMENT

Figure 1:
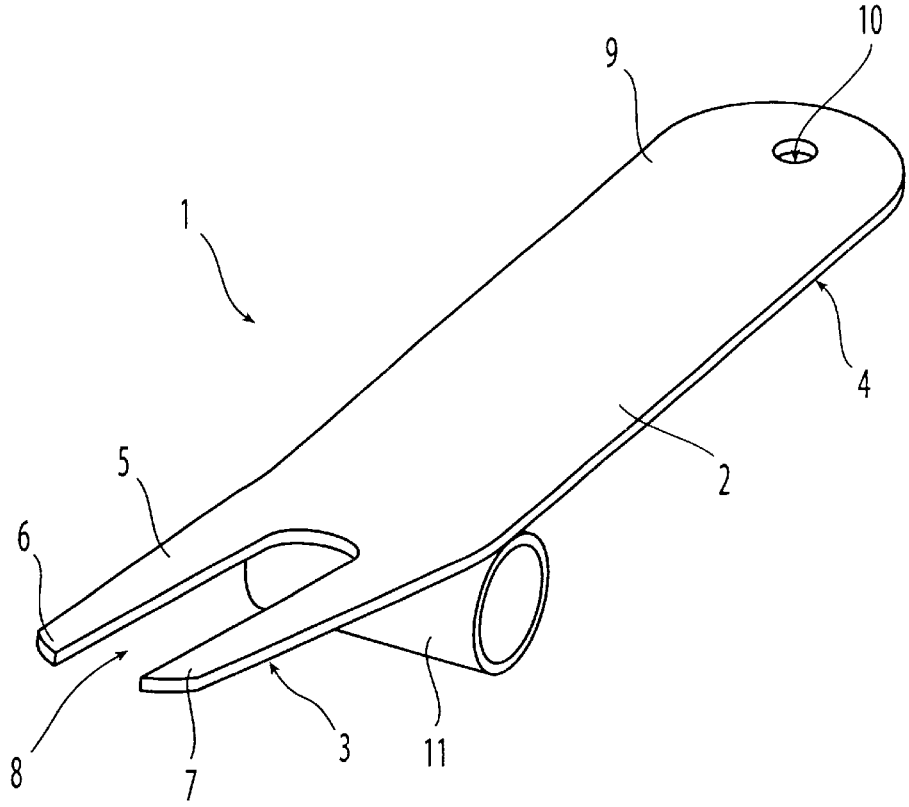
FIG. 1 is a front perspective view of a turf repair device according to the present invention.

Referring now to FIG. 1, a turf repair device 1 constructed according to a preferred embodiment of the present invention is shown having a base member 2 with a first portion 3 and a second portion 4. The first portion 3 includes at least one extension 5, two of which are shown as two prongs 6 and 7, extending outwardly. The prongs 6 and 7 preferably form a U-shape with an opening 8 facing away from the second portion 4. Additional extensions having other formations are equally suitable for use with the present invention. Preferably, the prongs 6 and 7 are sufficiently sharp to assist the golfer in inserting the turf repair device 1 into the sod surrounding the impacted area of a ball mark. The prongs 6 and 7, however, should not be too sharp as to pose danger to the golfer while the turf repair device 1 is not in use. The second portion 4 is preferably substantially flat and elongated to provide an easily graspable handle 9 to the golfer during use. An aperture 10 is shown in FIG. 1 to threading a string, velcro or linked chain so that the turf repair device 1 may be attached to the golfer's attire, golf bag or other golf accessories.

Figure 2:
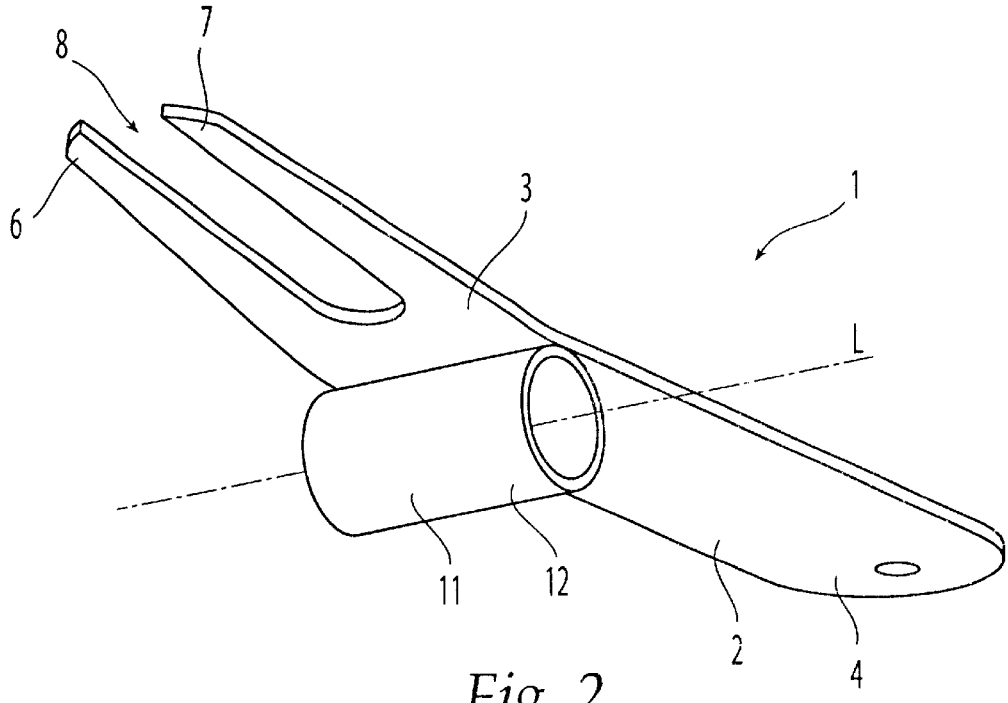
FIG. 2 is bottom perspective view of the turf repair device of FIG. 1, showing a pivot member.

A pivot member 11 is connected to the base member 2 to allow for pivotal movement thereof. As better shown in FIG. 2, the pivot member 11 is shown as a substantially cylindrical tube, defining a longitudinal axis L extending therethrough. The cylindrical shape of the pivot member 11 provides an arcuate outer surface 12 that facilitates rolling or pivotal movement of the turf repair device 1. The pivot member 11 is preferably attached substantially to the center of the base member 2 such that first and second portions 3 and 4 are disposed on opposite sides thereof. In this manner, the pivot member 11 provides leverage for pivoting the first and second portions 3 and 4 with respect to each other. The pivot member 11 may alternatively be integrally constructed with the base member 2.

Figure 3:
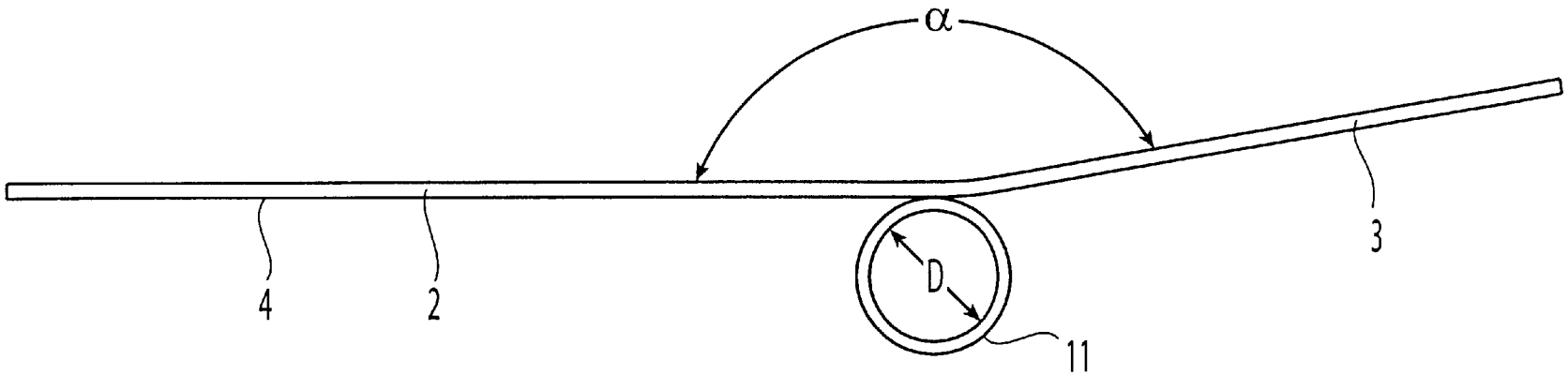
FIG. 3 is a side view of the turf repair device of FIG. 1.

The cylindrical tube pivot member 11 additionally has a diameter D, best shown in FIG. 3, that is preferably less than 1 inch. More preferably, the pivot member 11 has a diameter D between about ¼ to ¾ inches. Most preferably, the pivot member 11 has a diameter D about ½ inch. Alternatively, the diameter D of the pivot member 11 may be modified to accommodate different sizes of the base member 2. A larger diameter D will provide greater leverage during the use of the turf repair tool. As the diameter increases, however, the overall dimensions of turf repair device 1 also increases, which may be a disadvantage to the compactness of the turf repair device 1. Accordingly, the diameter D of the pivot member is preferably selected to facilitate the use of the turf repair device 1 while ensuring that the overall dimension of the device 1 is sufficiently compact so that the turf repair device 1 can be easily fitted in the golfer's pocket.

The first and second portions 3 and 4 define an angle $\alpha$ on the side of the base member 2 opposite from the pivot member 11, forming an angled base member 2, as shown in FIG. 3. Preferably, the angle $\alpha$ defined by the first and second portions 3 and 4 is between about 135° and 175°. Most preferably, the angle $\alpha$ is about 160°. The angled base member 2, in combination with the pivot member 11, further assists the pivotal movement of the turf repair device 1 in repairing the ball mark. The pivot member 11 is shown as secured to the base member 2, at the angled portion of the base member 2. This construction maximizes the pivotal movement of the base member 2. Other locations along the base member 2 are also suitable for securing the pivot member 11. Moreover, the second portion 4 is shown as having a greater length than the first portion 3 in FIG. 3. This construction also facilitates the pivotal movement of the base member 2 by increasing the leverage provided by the second portion 4. Alternatively, the first and second portions 3 and 4 may be equal in length or the first portion 3 may be longer than the second portion 4.

In use, the golfer holds the second portion 4 of the turf repair device 1 in the palm of his hand and inserts the prongs 6 and 7 of the first portion 3 into the sod area surrounding a ball mark and with the pivot member 11 resting against the non-impacted portions of the playing turf. The prongs 6 and 7 are positioned with the ball mark positioned in the opening 8. When so inserted, the golfer presses down on the handle 9 of the second portion 8 and pivots the prongs 6 and 7 of the first portion 3 against the pivot member 11. The curved outer surface 12 of the pivot member 11 facilitates the pivotal movement of the turf repair device 1 and substantially alleviates the need for the golfer's hand to come in contact with the sod, while providing greater leverage to the turf repair device 11 in repairing the ball mark. Additionally, the angled base member 2 further facilitates the pivotal movement by maximizing the leverage provided by the handle 9 of the second portion 4 of the base member 2. Accordingly, by easily pressing down on the handle 9 of the second portion 4 several times, the golfer may easily move, lift and rearrange the sod surrounding the ball mark to fill and repair the ball mark.

Preferably the base member 2 of the turf repair device 1 is sized to be gripped comfortably in the palm of the golfer's hand. In this manner, the device 1 is easily manipulated during use. The prongs 6 and 7 are preferably configured and dimensioned to extend sufficiently into the sod to cover the impacted area formed by the golf ball. As stated above, ball marks are formed when the ball strikes the ground. Accordingly, the shape of ball marks typically conforms to a portion of the golf ball, with the size of the ball mark depending on the force of impact the ball makes with the ground and the condition of the ground. Since most golf balls have a diameter of approximately 1.68 inches, the length of the prongs 6 and 7 should be greater than ½ of the diameter of the ball, or at least 0.84 inches. Preferable, the length of the prongs 6 and 7 are at least 1.25 inches to provide ample leverage and assist the pivotal movement of the base member 2.

The turf repair device 1 may be constructed from any material having sufficient flexural strength to suit various desirable taste and purposes. For example, the device 1 may be stamped from steel that is heated and treated. The device 1 may thereafter be plated with copper, nickel and chrome or other suitable quality finishes. Alternatively, the device 1 may be constructed from plastic materials. The device 1 may further be embellished with logos or other trademarks for advertising purposes.

Figure 4:
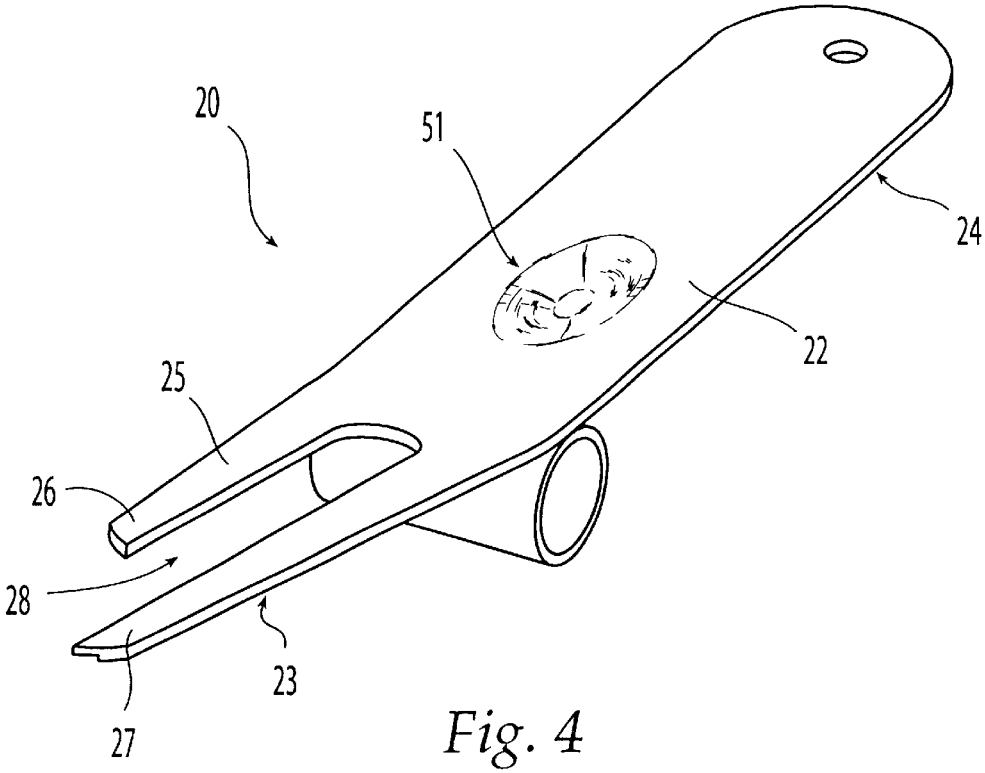
FIG. 4 is a perspective view of a second embodiment of a turf repair device according to the present invention.

Referring now to FIG. 4, another embodiment of the turf repair device constructed according to the present invention is shown. Turf repair device 20 is shown having a base member 22 with a first portion 23 and a second portion 24. The first portion 23 includes at least one extension 25, shown as two prongs 26 and 27, extending therefrom. The two prongs 26 and 27 form a U-shape with an opening 28 facing away from the base member 22. Unlike the turf repair device 1 of the previous embodiment, prong 27 of the turf repair device 20, however, is longer than prong 26. Preferably prong 27 is about ½ inches longer than prong 26. More preferably, prong 27 is about ¼ inches longer than prong 26. Most preferably, prong 27 is about ⅛ inches longer than prong 26.

Figure 5:
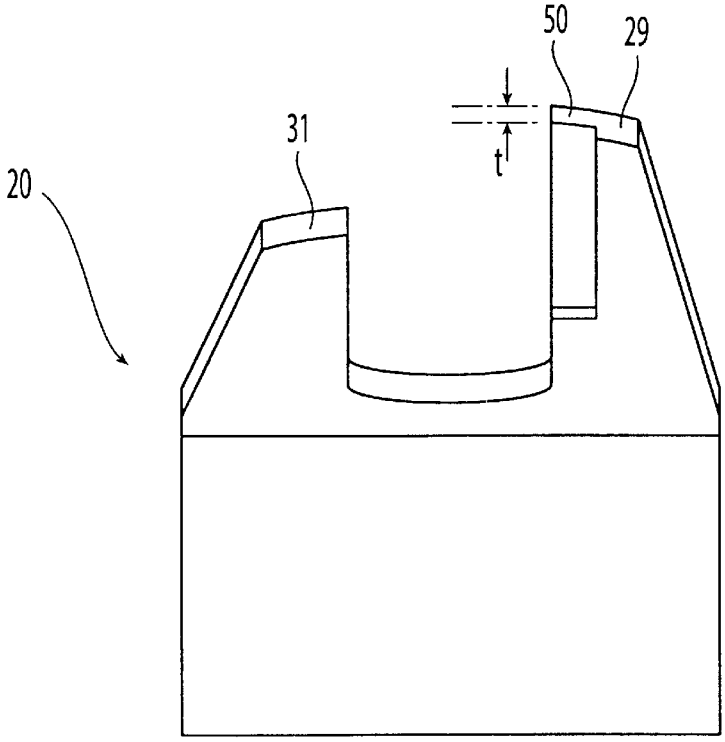
FIG. 5 is a front view of the turf repair device of FIG. 4.

Moreover, prongs 27 has a first tip end 29 with a step 50, while prong 26 has a flat tip end 31, best shown in FIG. 5. First tip end 29 accordingly has a cross-sectional area that is less than the cross-sectional area of the flat tip end 31. The step 50 of prong 27 is constructed with a thickness t adapted to fit standard size groves found on the face of a club head. Thickness t is preferably less than 0.035 inches, which is the standard width of grooves found on club heads. Accordingly, the golfer may use the tip end 29 of the turf repair device 20 to clean the grooves of the club face during the course of the game. The longer construction of prong 27 ensures greater ease in targeting the grooves on the club face without having prong 26 getting in the way. The turf repair device 20 is used in a similar manner for repairing the playing turf as turf repair device 1. The added feature of step 50 for turf repair device 20 is beneficial for cleaning the scorelines of a golf club since dirt is often left in the scorelines of the club face after the golfer executes a swing.

A concave or thumb area 51 is shown in FIG. 4 disposed on the base member 22. The thumb area 51 is preferably configured so that the thumb of a golfer may press against the thumb area 51 to apply force to the second portion 24 of the base member 22. The thumb area 51 preferably has a non-smooth surface, such as a texturalized surface, to improve contact with and to enhance the gripping force provided by the thumb of the golfer. Additionally, the thumb area 51 preferably has a length that is elongated with respect to the base member 22. The length is configured to comfortably accommodate the thumb of most golfers. More preferably, the length is about 1 inch.

Figure 6:
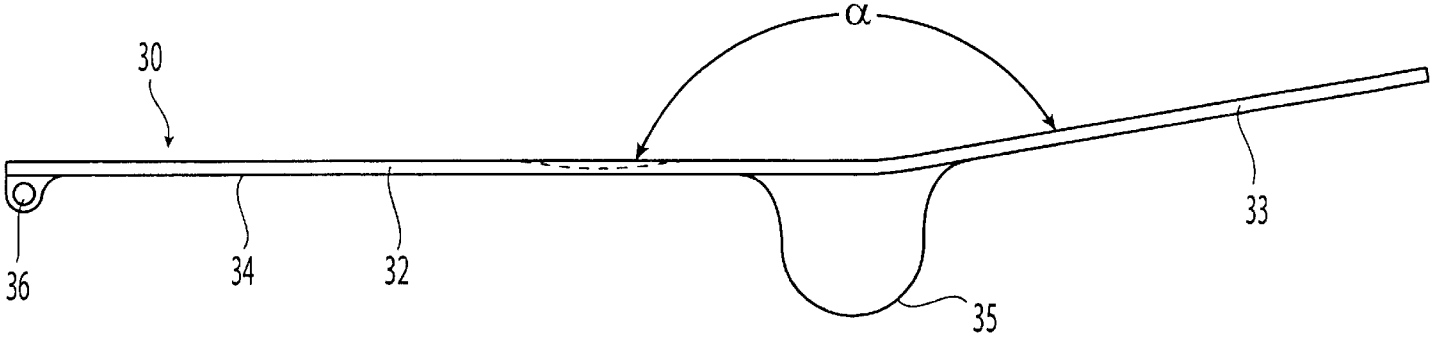
FIG. 6 is a third embodiment of a turf repair device according to the present invention.

Referring now to FIG. 6, a third embodiment of a turf repair device 30 is shown having a base member 32 with first and second portions 33 and 34. The turf repair tool 30 differs from the previous embodiments in that a pivot mimer 35 is of a solid construction. Such construction allows greater strength in the device 30 as well as preventing the device 30 from catching other tools and equipment in the golfer's bag. Additionally, a loop 36 is included in the turf repair device 30 for allowing the golfer to secure the device 30 to the golf bag by threading a chain or other known attachment devices therethrough.

Figure 7:
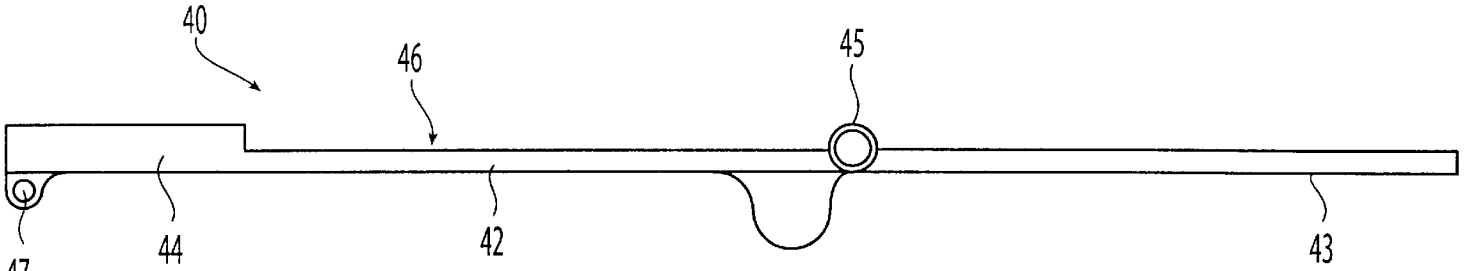
FIG. 7 is perspective view of a fourth embodiment of a turf repair device according to the present invention, showing a pivot joint disposed between first and second portions in an opened position.
Figure 8:
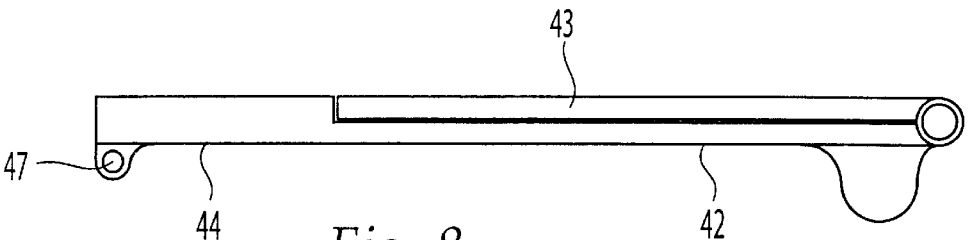
FIG. 8 is a perspective view of the turf repair device of FIG. 7, showing the first and second portions in a closed position.

As stated previously, the turf repair tool is preferably constructed to facilitate the use of the tool by the golfer during the game. Accordingly, a fourth embodiment of a turf repair tool 40 constructed according to the present invention is shown in FIG. 7 directed to providing greater compactness and transportability. Turf repair tool 40 is similar to the earlier embodiments and has a base member 42 with first and second portions 43 and 44. A folding joint 45 is disposed on the base member 42 between the first and second portions 43 and 44. FIG. 7 shows the device 40 in an opened configuration with the folding joint 45 having a hinge-like construction. The folding joint 45 allows the first and second portions 43 and 44 to collapse into an abutting contact as shown in FIG. 8. Other types of folding connections known in the art including pivotal connections may also be suitable such as a living hinge, a spring bias, male or female coupling or telescoping parts.

Referring back to FIG. 7, first and second portions are shown respectively having first and second thicknesses such that the second thickness is greater than the first thickness. Additionally, a recess 46 is disposed on the second portion 44 for receiving the first portion 43 with the device 40 is a closed configuration. Preferably, the recess 46 is dimensioned and configured to receive the first potion 43 such that in the closed configuration, the first and second portions 43 and 44 are substantially flushed with respect to each other. In other words, in the closed position, the first portion 43 is collapsed or folded toward the second portion 44 and is received in the recess 46 for abutting contact therewith such that the non-abutting surface of the first member 43 is substantially coplanar with the non-abutting surface of the second portion 44. Additionally, the folding joint 45 is located such that the device 40 in the closed configuration is preferably about half of the device 40 in the opened configuration. In this manner, the device 40 forms a compact and non-obtrusive package that may be carried easily by the golfer on a chain threaded through a chain loop 47 or attached the golf bag or the like.

While it is apparent that the illustrative embodiments of the invention herein disclose and fulfills the objective stated above, it will be appreciated that numerous modifications and other embodiments may be devised by those skilled in the art. Therefore, it will be understood that the appended claims are intended to cover all such modifications and embodiments which come within the spirit and scope of the present invention.

I claim:

1. A hand-held turf repair device for repairing impacted turf of a golf course, comprising:

a. a base member;

b. a first portion disposed on said base member having at least one extension extending therefrom and insertable into said impacted turf;

c. a second portion disposed on said base member opposite from said at least one extension, said second portion providing leverage to said extension with respect to said first portion;

d. a pivot member associated with said base member for pivotal movement of said first and second portions to loosen said impacted turf when said at least one extension is inserted into said impacted turf; and e. a folding joint such that said first portion is collapsible about said folding joint toward said second portion;

wherein the first portion has a substantially uniform thickness from an end of the extension to the pivot member; and wherein said first portion has a first thickness and said second portion has a second thickness greater than said first thickness of said first portion; said second thickness of said second portion defines a recess to receive said first portion.

2. The turf repair device of claim 1, wherein said first portion is collapsible toward said recess for abutting contact therebetween and is received therein such that a non-abutting surface of said first portion is substantially coplanar with a non-abutting surface of said second portion.

* * * * *